United States Patent [19]

Wassenhoven et al.

[11] Patent Number: 4,541,234

[45] Date of Patent: Sep. 17, 1985

[54] METHOD AND DEVICE FOR STARTING THE OPERATION OF A FRICTION SPINNING MACHINE

[75] Inventors: Heinz-Georg Wassenhoven; Josef Derichs, both of Monchen-Gladbach, Fed. Rep. of Germany

[73] Assignee: W. Schlafhorst & Co., Monchen-Gladbach, Fed. Rep. of Germany

[21] Appl. No.: 612,434

[22] Filed: May 21, 1984

[30] Foreign Application Priority Data

May 21, 1983 [DE] Fed. Rep. of Germany ..... 3318701
Sep. 29, 1983 [DE] Fed. Rep. of Germany ..... 3335211

[51] Int. Cl.[4] ..... D01H 15/02; D01H 13/12

[52] U.S. Cl. ..... 57/263; 57/401; 57/305

[58] Field of Search ..... 57/22, 261, 263, 279, 57/280, 300, 301, 304–306, 400, 401, 332, 334, 335, 337, 338, 348, 352, 353

[56] References Cited

U.S. PATENT DOCUMENTS

| | | | |
|---|---|---|---|
| 3,198,446 | 8/1965 | Furst et al. | 57/305 X |
| 4,327,545 | 5/1982 | Fehrer | 57/401 X |
| 4,334,400 | 6/1982 | Fehrer | 57/401 X |
| 4,362,008 | 12/1982 | Parker et al. | 57/401 X |
| 4,367,623 | 1/1983 | Parker et al. | 57/263 |
| 4,463,548 | 8/1984 | Karl et al. | 57/305 X |

*Primary Examiner*—Donald Watkins
*Attorney, Agent, or Firm*—Herbert L. Lerner; Laurence A. Greenberg; Adam A. Jorgensen

[57] ABSTRACT

Method for starting the operation of a friction spinning machine, including friction surfaces movable in opposing directions for forming a spinning wedge, a device for supplying fiber to the spinning wedge, a thread withdrawal device, at least one suction device acting on the spinning wedge during the spinning operation, a suction tube disposed at an end of the machine opposite the thread withdrawal device, and a suction air source connectible to the suction device and to the suction tube, which includes:

stopping the fiber supply and the motion of the friction surfaces;

disconnecting the suction device from the suction source;

supplying suction air from the suction source through the suction tube at the spinning wedge for inserting a thread into the spinning wedge;

keeping the thread in a tensioned condition in vicinity of the spinning wedge;

operating the suction device with a given suction power;

moving the friction surfaces around the thread with a given speed to remove the twist of the thread at a given location;

breaking the thread with tension at the given location severing a piece of thread;

sucking the severed piece of thread into the suction tube; resuming the fiber supply at a given rate;

moving the friction surfaces in opposing directions at a pre-determined speed greater than the given speed; and resuming a normal state of the machine for the spinning operation by supplying the fiber at a rate greater than the given rate, increasing the suction power of the suction device beyond the given suction power, increasing the speed of motion of the friction surfaces to a speed above the predetermined speed, and increasing the thread withdrawal speed.

13 Claims, 2 Drawing Figures

METHOD AND DEVICE FOR STARTING THE OPERATION OF A FRICTION SPINNING MACHINE

Figure 1:
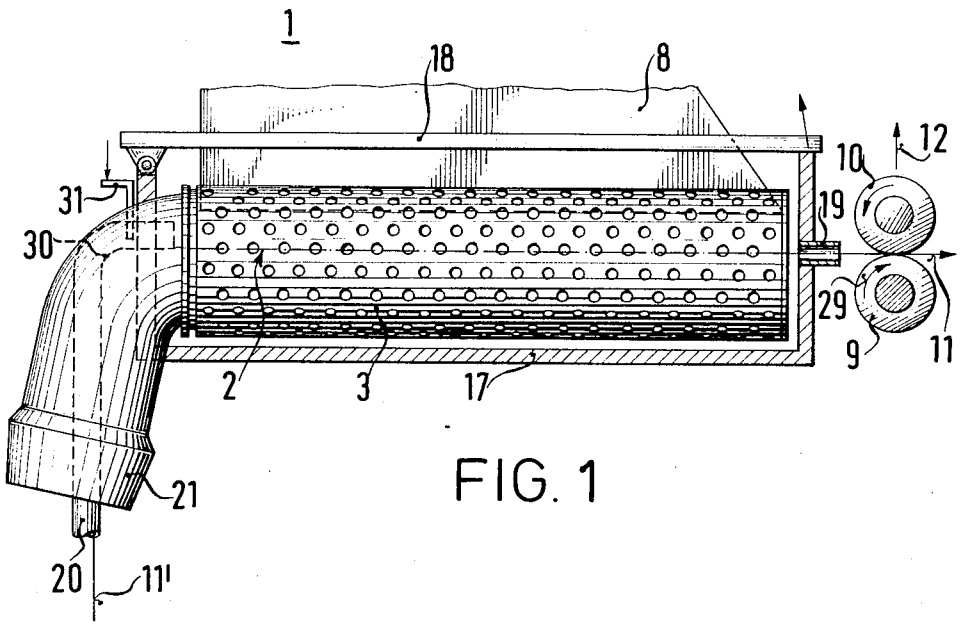

The invention relates to a method and a device for starting the operation of a friction spinning machine, especially for repairing a broken thread, including friction surfaces moving in opposite directions and forming a spinning wedge, a fiber supply device, a fiber withdrawal device, and at least one suction device acting on the spinning wedge during the spinning operation.

The friction surfaces of friction spinning machines of this type may be in the form of two adjacent perforated drums which rotate in the same direction or sense, and form a spinning wedge therebetween. The spinning fibers are introduced in a dissolved form into the spinning wedge. A stationary suction device with a suction slit directed toward the spinning wedge is disposed within at least one of the perforated drums. The inlet of the suction device is disposed closely adjacent the wall of the drum, just close enough to permit the drum to continue to rotate freely.

Friction spinning machines of this type can be operated automatically. The start up of such a spinning machine is done by hand. The repair of a broken thread is also done manually, and consequently depends on manual dexterity. The quality of the thread connection region varies greatly, and depends on chance and especially on the dexterity of the operator.

It is accordingly an object of the invention to provide a method and device for starting the cooperation of a friction spinning machine, which overcomes the hereinafore-mentioned disadvantages of the heretofore-known methods and devices of this general type, and to permit an automated start of the friction spinning machine, especially for repairing thread breaks.

With the foregoing and other objects in view there is provided, in accordance with the invention, a method for starting the operation of a friction spinning machine, especially for eliminating a thread break, including friction surfaces movable in opposing directions for forming a spinning wedge, a device for supplying fiber to the spinning wedge, a thread withdrawal device, at least one suction device acting on the spinning wedge during the spinning operation, a suction tube disposed at an end of the machine opposite the thread withdrawal device, and a suction air source connectible to the suction device and to the suction tube, which comprises:

stopping the fiber supply and the motion or rotation of the friction surfaces;

disconnecting the suction device from the suction source;

supplying suction air from the suction source through the suction tube at the spinning wedge for inserting a thread end or a starting thread or a starting thread into the spinning wedge;

keeping the thread in a tensioned condition in vicinity of the spinning wedge;

operating the suction device with a given reduced suction power;

moving the friction surfaces around the thread with a given speed to remove the twist of the thread at a given location;

breaking the thread with tension at the given location severing a piece of thread;

sucking the severed piece of thread into the suction tube;

resuming the fiber supply at a given rate;

moving the friction surfaces in opposing directions at a pre-determined speed greater than the given speed; and resuming a normal state of the machine for the spinning operation by supplying the fiber at a rate greater than the given rate, increasing the suction power of the suction device beyond the given suction power, increasing the speed of motion or rotation of the friction surfaces to a speed above the predetermined speed, and increasing the thread withdrawal speed.

In accordance with another feature of the invention, the method includes applying suction air to the spinning wedge through the suction tube opposite the thread withdrawal device, for a given length of time.

In accordance with a further feature of the invention, the method includes carrying out the step of tensioning the thread by using air suction.

In accordance with an additional feature of the invention, the method includes stopping the motion of the friction surfaces again and ending the sucking of the thread, after the severed piece of thread is sucked into the suction tube.

In accordance with an added feature of the invention, the method includes holding the thread stationary outside the spinning wedge, at least until the thread twist is removed.

In accordance with yet another feature of the invention, the method includes holding the thread stationary at least downstream of the spinning wedge, as seen in the thread withdrawal direction.

In accordance with yet a further feature of the invention, the method includes immediately stopping the fiber feed, stopping the motion of the friction surfaces, and switching off the suction device, when a thread break occurs during a normal spinning operation.

In accordance with yet an added feature of the invention, the method includes connecting the suction device to atmospheric air pressure at least as late as the point in time when the suction device is disconnected from the suction air source.

In accordance with yet an added feature of the invention, the method includes connecting the suction device to a compressed air source at least as late as the point in time when the suction device is disconnected from the suction air source.

In order to carry out the method, there is provided a device for starting the operation of a friction spinning machine, comprising friction surfaces movable in opposing directions for forming a spinning wedge, a device for supplying fiber to the spinning wedge, at least one suction device acting on the spinning wedge during the spinning operation, a housing surrounding the spinning wedge and at least part of the friction surfaces, a thread withdrawal device adjacent the housing, a suction tube extended into an end of the housing opposite the thread withdrawal device and directed toward the spinning wedge, and means for supplying suction air to the suction tube during start up of the friction spinning machine.

In accordance with again another feature of the invention, the suction tube includes means for holding a thread sucked into the suction tube.

In accordance with a again a further feature of the invention, the holding means are in the form of a bend in the suction tube.

In accordance with a concomitant feature of the invention, the holding means are in the form of a controlled thread clamp.

The advantages obtained by practicing the invention lie especially in the fact that the start up of the spinning operation, or the repair of a thread break can be performed rapidly and reliably. Performance based on manual dexterity is eliminated. The quality of the thread connections is increased.

Other features which are considered as characteristic for the invention are set forth in the appended claims.

Although the invention is illustrated and described herein as embodied in a method and device for starting the operation of a friction spinning machine, it is nevertheless not intended to be limited to the details shown, since various modifications and structural changes may be made therein without departing from the spirit of the invention and within the scope and range of equivalents of the claims.

Figure 2:
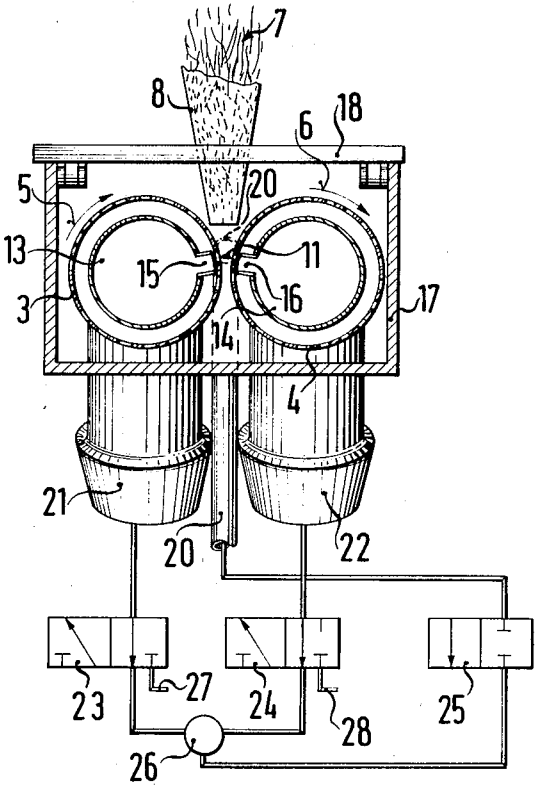

The construction and method of operation of the invention, however, together with additional objects and advantages thereof will be best understood from the following description of specific embodiments when read in connection with the accompanying drawings, in which:

FIG. 1 is a diagrammatic, partly longitudinal sectional view of a device for starting up a friction spinning machine according to the invention; and FIG. 2 is a cross-sectional view of the device according to FIG. 1, including a schematically illustrated suction air system.

Referring now to FIGS. 1 and 2 of the drawings in detail, there is seen a friction spinning machine 1, including only those parts which are necessary for an understanding of the invention. The friction spinning machine 1 includes two friction surfaces 3, 4 which can move in opposing directions, and which form a spinning wedge 2. The friction surfaces 3, 4 are constructed in the form of perforated drums. During the spinning operation the drums rotate in the same direction or sense, which is in the direction of the arrows 5, 6. The rotation of the drums in the same sense implies that the friction surfaces move in the opposite direction or sense at the spinning wedge 2. The spinning fibers 7 are conducted into the spinning wedge 2 through a funnel 8. A spun thread 11 is pulled out of the spinning zone or the spinning wedge 2 by a pair of withdrawal or delivery rollers 9, 10. The roller 9 is provided with its own driver, while the roller 10 functions as a pressure roller, and can be lifted from roller 9 in the direction of the arrow 12.

Each of the two drums contains a suction device 13, 14 respectively, for the spinning operation. The two suction devices 13, 14 act on the spinning wedge 2 by virtue of the fact that their slit-like suction nozzles 15, 16, respectively, are directed toward the lower end of the spinning wedge 2. The thread forms on the friction surfaces 3, 4 in vicinity of the suction nozzles.

The friction spinning machine 1 has a housing 17 which surrounds the spinning wedge 2 and the friction surfaces 3, 4 and can be closed by a hinged cover 18 that can be swung open. A thread withdrawal tube 19 is inserted in the wall of the housing 17, at the side where the thread is pulled out. A suction tube 20 terminates in the housing 17 at the side opposite the tube 19. The suction tube 20 is directed against the spinning wedge 2, and is supplied with suction air during the start up of the spinning machine 1. The suction tube 20 has a rather narrow bend 30 of about 90° and controllable clamp 31 for holding the sucked-in thread 11'. Depending on operational conditions of the spinning machine, it may be sufficient for the thread to only be held in a tensional condition by air suction in vicinity of the spinning wedge. Two suction tubes 21, 22 which are provided for the suction device 13, 14 are connected to a source 26 of suction air, through directional valves 23, 24. The suction tube 20 can be connected to the suction air source by a directional valve 25. The rotational drives of the drums 3 and 4 are not further illustrated in this context.

If the thread 11 breaks, the fiber feed is immediately stopped to avoid uncontrollable milling or fulling. And the motion of the friction surfaces is stopped, as is the spinning operation of the suction device. This can be done automatically, such as by thread monitor which controls the fiber supply device, the drive apparatus of the two drums 3, 4 and the directional valves 23, 24. By switching the directional valves 23, 24 the two spinning operation suction devices 13, 14 are vented to the atmosphere by two ventilating feed tubes 27, 28. This assists and facilitates the following suction operation which is initiated by switching the valve 25.

The end 11' of the broken thread 11 is then sucked in by the suction tube 20. The roller 10 of the withdrawal roller pair can thus be lifted from roller 9 in the direction of the arrow 12. The return movement of the thread end can also be assisted by rotating the roller 9 against the direction of arrow 29, and by placing the roller 10 into the roller 9. If the thread end is sucked in by the suction tube 20, the thread travels into the spinning wedge 2, and is held there in a tensioned state. The sucked in thread 11' lies at the inner side of the tube bend 30, which acts like a clamp on the thread. Additionally or instead of this, the thread clamp 31 may also be closed. The thread clamp 31 is constructed like a slider which projects through a slot into the suction tube 20, and clamps the thread 11' at the bottom of the tube 20. As soon as the thread lies in the spinning wedge 2, the suction devices 13, 14 are supplied with a reduced amount of free air capacity by switching the directional valves 23 and 24, while simultaneously throttling the source 26 which supplies the suction air, and setting the friction surfaces 3 and 4 in motion in the direction of the arrows 5 and 6. In general, this is the same direction in which the friction surfaces 3 and 4 are moved during the spinning operation. In this way the thread twist is removed from the thread. This should preferably take place at the rear or at the far end of the spinning wedge 2. However, depending on the fiber material and the type of spinning operation, the removal of the twist in the thread can also be accomplished by first rotating the friction surfaces 3 and 4 against the direction used during the spinning operation, i.e. against the direction of the arrows 5 and 6.

As soon as the twist is removed from the thread, if the thread clamp 31 was closed it is again opened, and the thread is interrupted by the action of the air suction, because the cohesion of the fibers is reduced, and the tension of the thread overcomes the holding forces. The severed thread piece is sucked away into the suction tube 20. The suction operation can then be stopped by switching the directional valve 25. The feeding of fibers is then resumed, i.e. the non-illustrated fiber supply device is again activated. Thereby, the friction surfaces 3 and 4 rotate with increasing velocity in the direction of the arrows 5 and 6. Finally the fiber feed, the suction strength or free air capacity of the spinning operation suction devices 13, 14, the motion of the friction surfaces 3, 4, and the withdrawal of the thread with the aid of the delivery roller pair 9, 10, are adjusted and increased until the normal spinning operation is established. The adjustment mainly serves the purpose of forming a thread of the desired gage and twist with a specified velocity.

Transitions of the sequence of the individual operational steps may be used. The first and second operational steps may be omitted for the initial start up of the machine.

The new thread end generated by the interruption of the thread has a fiber formation which is quite suitable for the start of the spinning operation. During the whole procedure the thread is held under tension at one side by the withdrawal or delivery roller pair 9, 10, at the other side by the negative pressure in the suction tube 20, and in some cases for a short time it is also held by the thread clamp 31.

The invention is not limited to the illustrated and described embodiment.

Many similar friction spinning units can be combined to form a friction spinning machine. A travelling device for joining threads and starting the spinning operation can be used for the repair of thread breaks. Starting at least with the insertion of the thread into spinning wedge, such a device initiates and effects all of the operational steps.

Deviating from the specific embodiment which is used as an example, in some individual cases before the thread twist is removed, it may be better to dispense with the venting of the suction devices, or the application of positive pressure to these devices, or to delay this at least for some interval, in order to facilitate the suction of the thread into the tube 19.

It is also advantageous to connect the suction tube 20 to a separate suction source, such as a transportable thread joining device, in order to permit the pressure level thereof to be independent of the pressure level of the suction air source 26 used during the spinning operation. In some circumstances with a different piping arrangement, a single directional valve of the suction tube 20, may suffice for the supply of the suction devices during the spinning operation.

The foregoing is a description corresponding, in substance, to German applications No. P 33 18 701.0 dated May 21, 1983 and No. P 33 25 211.9 dated Sept. 29, 1983, international priority of which is being claimed for the instant applications, and which are hereby made part of this application. Any material discrepancies between the foregoing specification and the specification of the aforementioned corresponding German applications is to be resolved in favor of the latter.

In the claims:

1. Method for starting the operation of a friction spinning machine, including friction surfaces movable in opposing directions for forming a spinning wedge, a device for supplying fiber to the spinning wedge, a thread withdrawal device, at least one suction device acting on the spinning wedge during the spinning operation, a suction tube disposed at an end of the machine opposite the thread withdrawal device, and a suction air source connectible to the suction device and to the suction tube, which comprises:

stopping the fiber supply and the motion of the friction surfaces;

disconnecting the suction device from the suction air source;

supplying suction air from the suction source through the suction tube at the spinning wedge for inserting a thread into the spinning wedge;

keeping the thread in a tensioned condition in vicinity of the spinning wedge;

operating the suction device with a given suction power;

moving the friction surfaces around the thread with a given speed to remove the twist of the thread at a given location;

breaking the thread with tension at the given location severing a piece of thread;

sucking the severed piece of thread into the suction tube;

resuming the fiber supply at a given rate;

moving the friction surfaces in opposing directions at a pre-determined speed greater than the given speed; and resuming a normal state of the machine for the spinning operation by supplying the fiber at a rate greater than the given rate, increasing the suction power of the suction device beyond the given suction power, increasing the speed of motion of the friction surfaces to a speed above the predetermined speed, and increasing the thread withdrawal speed.

2. Method according to claim 1, which comprises applying suction air to the spinning wedge through the suction tube opposite the thread withdrawal device, for a given length of time.

3. Method according to claim 1, which comprises carrying out the step of tensioning the thread by using air suction.

4. Method according to claim 1, which comprises stopping the motion of the friction surfaces again and ending the sucking of the thread, after the severed piece of thread is sucked into the suction tube.

5. Method according to claim 1, which comprises holding the thread stationary outside the spinning wedge, at least until the thread twist is removed.

6. Method according to claim 5, which comprises holding the thread stationary at least downstream of the spinning wedge, as seen in the thread withdrawal direction.

7. Method according to claim 1, which comprises immediately stopping the fiber feed, stopping the motion of the friction surfaces, and switching off the suction device, when a thread break occurs during a normal spinning operation.

8. Method according to claim 1, which comprises connecting the suction device to atmospheric air pressure at least as late as the point in time when the suction device is disconnected from the suction air source.

9. Method according to claim 1, which comprises connecting the suction device to a compressed air source at least as late as the point in time when the suction device is disconnected from the suction air source.

10. Device for starting the operation of a friction spinning machine, comprising friction surfaces movable in opposing directions for forming a spinning wedge, a device for supplying fiber to the spinning wedge, at least one suction device acting on the spinning wedge during the spinning operation, a housing surrounding the spinning wedge and at least part of said friction surfaces, a thread withdrawal device adjacent said housing, a suction tube extended into an end of said housing opposite said thread withdrawal device and directed toward the spinning wedge, and means for supplying suction air to said suction tube during start up of the friction spinning machine.

11. Device according to claim 10, wherein said suction tube includes means for holding a thread sucked into said suction tube.

12. Device according to claim 11, wherein said holding means are in the form of a bend in said suction tube.

13. Device according to claim 12, wherein said holding means are in the form of a controllable thread clamp.

* * * * *